US007522137B2

(12) United States Patent
Park et al.

(10) Patent No.: US 7,522,137 B2
(45) Date of Patent: Apr. 21, 2009

(54) LIQUID CRYSTAL DISPLAY DEVICE AND METHOD OF FIELD SEQUENTIAL DRIVING MODE

(75) Inventors: Dong-Jin Park, Daegu (KR); Tae-Hyeog Jung, Yangsan-si (KR); Hae-Jin Heo, Ulsangwangyeok-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 321 days.

(21) Appl. No.: 10/893,225

(22) Filed: Jul. 19, 2004

(65) Prior Publication Data

US 2005/0068285 A1 Mar. 31, 2005

(30) Foreign Application Priority Data

Sep. 29, 2003 (KR) ..... 10-2003-0067528

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/99, 98, 690

See application file for complete search history.

(56) References Cited

U.S. PATENT DOCUMENTS 6,084,561 A * 7/2000 Kudo et al. ..... 345/89
6,492,054 B1 12/2002 Yamano et al.
6,493,054 B2 * 12/2002 Mizunuma et al. ..... 349/123
6,710,818 B1 * 3/2004 Kasahara et al. ..... 348/607
6,831,618 B1 * 12/2004 Suzuki et al. ..... 345/60
7,002,546 B1 * 2/2006 Stuppi et al. ..... 345/102
2001/0003446 A1 * 6/2001 Takafuji ..... 345/98
2002/0126083 A1 * 9/2002 Cairns et al. ..... 345/98
2003/0193464 A1 * 10/2003 Yamano et al. ..... 345/89

(Continued)

FOREIGN PATENT DOCUMENTS

JP 06-067626 3/1994

(Continued)

OTHER PUBLICATIONS

*Office action* from the Korean Intellectual Property Office issued in Applicant's corresponding Korean Patent Application No. 10-2003-0067528 dated Jun. 30, 2005.

(Continued)

*Primary Examiner*—Amr Awad
*Assistant Examiner*—Randal Willis
(74) *Attorney, Agent, or Firm*—Robert E. Bushnell, Esq

(57) ABSTRACT

A liquid crystal display device of a field sequential driving mode is capable of improving flicker and obtaining a good contrast by driving at a certain driving frequency. The liquid crystal display device divides one frame into at least three sub-frames and displays R, G, B images for each sub-frame, and the one frame is driven at a driving frequency satisfying at least one of two conditions that flicker is less than 45% and that a contrast ratio is at least 100. The driving frequency driving the one frame ranges from 80 to 110 Hz. The driving frequency satisfying the condition that the flicker is less than 45% is more than 80 Hz. The driving frequency satisfying the condition that the contrast ratio is at least 100 is less than 110 Hz.

7 Claims, 2 Drawing Sheets

U.S. PATENT DOCUMENTS

| | | | | |
|---|---|---|---|---|
| 2003/0206185 | A1* | 11/2003 | Thebault et al. | 345/690 |
| 2003/0214725 | A1* | 11/2003 | Akiyama | 359/640 |
| 2004/0066363 | A1* | 4/2004 | Yamano et al. | 345/98 |
| 2005/0057580 | A1* | 3/2005 | Yamano et al. | 345/690 |
| 2005/0140634 | A1* | 6/2005 | Takatori | 345/96 |
| 2005/0168491 | A1* | 8/2005 | Takahara et al. | 345/690 |
| 2005/0180083 | A1* | 8/2005 | Takahara et al. | 361/152 |

FOREIGN PATENT DOCUMENTS

| | | |
|---|---|---|
| JP | 09-127911 | 5/1997 |
| JP | 11-338424 | 12/1999 |
| JP | 2001-042290 | 2/2001 |
| JP | 2001-195039 | 7/2001 |
| JP | 2002-162944 | 6/2002 |
| JP | 2002-215110 | 7/2002 |
| JP | 2003-066920 | 3/2003 |
| JP | 2004-046140 | 2/2004 |
| WO | WO 03/027998 | 4/2003 |

OTHER PUBLICATIONS

Chinese Office Action corresponding to Chinese Patent Application No. 2004100682825, issued on Dec. 29, 2006.

U.S. Appl. No. 10/893,325, filed Jul. 19, 2004, to Dong-Jin Park et al., entitled *Method of Driving Display Device of Field Sequential Driving Mode*, which is concurrently filed with this application.

*Office action* from the Japanese Patent Office issued in Applicant's corresponding Japanese Patent Application No. 2004-275110 dated Jun. 17, 2008.

*Office action* from the Japanese Patent Office issued in Applicant's corresponding Japanese Patent Application No. 2004-275085 dated Jun. 10, 2008.

* cited by examiner

LIQUID CRYSTAL DISPLAY DEVICE AND METHOD OF FIELD SEQUENTIAL DRIVING MODE

CROSS REFERENCE TO RELATED APPLICATION

This application relates to a U.S. patent application which is concurrently submitted to the U.S. Patent & Trademark Office with this application, and which is based upon a Korean Priority Serial No. 2003-69310 entitled LIQUID CRYSTAL DISPLAY DEVICE OF FIELD SEQUENTIAL DRIVING MODE filed in the Korean Industrial Property Office on 6 Oct. 2003. The related application is incorporated herein by reference in its entirety.

CLAIM OF PRIORITY

This application makes reference to, incorporates the same herein, and claims all benefits accruing under 35 U.S.C. §119 from an application for LIQUID CRYSTAL DISPLAY DEVICE OF FIELD SEQUENTIAL DRIVING MODE earlier filed in the Korean Intellectual Property Office on 29 Sep. 2003 and there duly assigned Serial No. 2003-67528.

BACKGROUND OF THE INVENTION

1. Field of the Invention

The present invention relates to a liquid crystal display device and, more particularly, to a liquid crystal display device of a field sequential driving mode, capable of improving flicker and obtaining a good contrast by optimizing a driving frequency.

2. Description of the Related Art

In general, a color liquid crystal display device includes a liquid crystal panel having upper and lower substrates and liquid crystals interposed between the two substrates, a driving circuit driving the liquid crystal panel, and a backlight providing white light to the liquid crystals. This liquid crystal display devices can be classified into two modes, an RGB (red, green, blue) color filter mode and a color field sequential driving mode, according to a color image displaying method.

The liquid crystal display device for the color filter mode is configured in such a manner that R, G, B color filters are arranged to R, G, B unit pixels respectively into which one pixel is divided. In this configuration, light is transmitted from a backlight through the liquid crystals to the R, G, B color filters, and thus color images are displayed.

By contrast, the liquid crystal display device of the color field sequential driving mode is configured in such a manner that R, G, B backlights are all arranged to one pixel which is not divided into R, G, B unit pixels. In the configuration, three primary colors of light, R, G, B, from the R, G, B backlights are sequentially displayed through the liquid crystals in a time-shared manner, and thus color images are displayed using an after-image effect of the eye.

Because the time interval of one frame generally driven at 60 Hz (hertz) is 16.7 ms (1/60 sec), in the field sequential driving mode liquid crystal display device divided into three sub-frames from one frame as described above, one sub-frame has the time interval of 5.56 ms (1/180 sec). The time interval of one sub-frame is very short, thereby any field change cannot be visually recognized. Therefore, the human eye may recognize it with an integrated time of 16.7 ms (millisecond), so that the combination of three primary colors, R, G, B, could be visually recognized.

Accordingly, compared with the color filter mode, the field sequential driving mode has advantages in that it can implement a resolution higher than almost three times the color filter mode under the condition that the panels are of the same size, increase the efficiency of light due to not using the color filter, and realize the same color reproduction as a color television and high-speed moving picture. In spite of these advantages, since one frame is divided into three sub-frames, the field sequential driving mode requires a driving frequency higher than six times the color filter driving mode. As such, high-speed operational characteristics are required for the field sequential driving mode.

Currently, in the liquid crystal display device of the digital field sequential driving mode, driving voltages having polarities different from each other are applied to the same pixel during the neighboring frames. Here, absolute values of each driving voltage applied to the same pixels for the neighboring frames are different from each other, so that the amount of transmitted light in the current frame is different from that of transmitted light in the next frame. Thus, the same pixels of the neighboring frames have different brightness, which results in flicker in the image.

Conventionally, the flicker caused by a difference of the amount of transmitted light between the neighboring frames has been prevented by adjustment of a common voltage applied to liquid crystal cells. However, it is difficult to fully prevent the flicker by means of only the adjustment of the common voltage.

SUMMARY OF THE INVENTION

Accordingly, the present invention is directed to solve the above-mentioned and other problems occurring in the earlier art, and an objective of the present invention is to provide a liquid crystal display device capable of improving flicker and obtaining a good contrast by optimizing a driving frequency.

It is another object to provide a display device of field sequential driving mode and a technique of driving the display device that is easy to implement and cost effective.

It is yet another object to provide a display device and a method of driving the display device that increases the quality of the displayed image.

In order to accomplish these and other objectives, the present invention is characterized in that a liquid crystal display device of a field sequential driving mode divides one frame into at least three sub-frames and displays R, G, B images for each sub-frame, wherein the one frame is driven at a driving frequency satisfying a condition that a contrast ratio is at least 100.

The driving frequency driving the one frame ranges from 80 to 110 Hz. The driving frequency satisfying the condition that the flicker is less than 45% is more than 80 Hz. The driving frequency satisfying the condition that the contrast ratio is at least 100 is less than 110 Hz.

Further, the present invention is characterized in that a liquid crystal display device of a field sequential driving mode divides one frame into at least three sub-frames and displays R, G, B images for each sub-frame, wherein the one frame is driven at a driving frequency satisfying conditions that a contrast ratio is higher than a predetermined value and that flicker is not visually recognized.

The driving frequency has a range from 80 to 110 Hz which satisfies conditions that flicker is less than 45% and that a contrast ratio is at least 100.

The present invention can also be realized as computer-executable instructions in computer-readable media.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
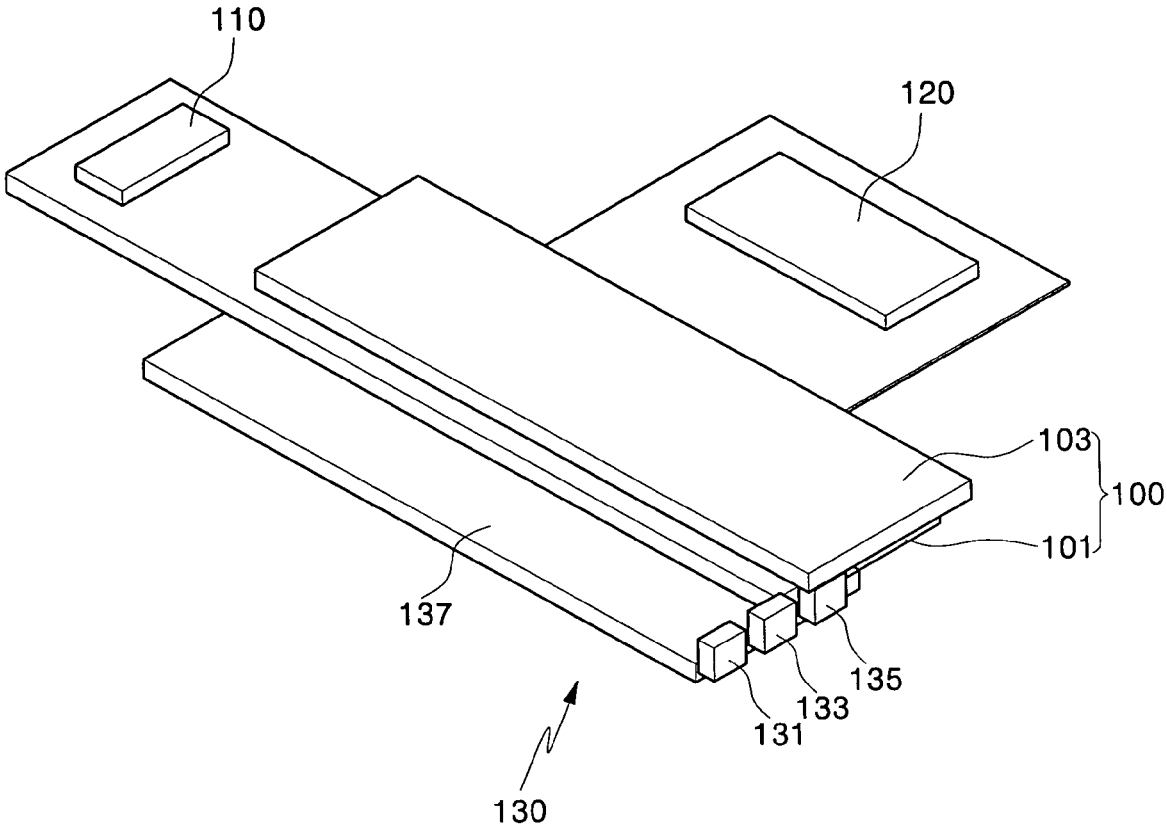
FIG. 1 schematically illustrates a construction of a liquid crystal display device of a color field sequential driving mode.

Turning now to the drawings, FIG. 1 schematically illustrates a configuration of a liquid crystal display device of a color field sequential driving mode.

Referring to FIG. 1, a liquid crystal display device includes a liquid crystal panel 100 composed of a lower substrate 101 on which a TFT (i.e., thin film transistor) array (not shown) is arranged with thin film transistors for switching, and connected to a plurality of gate lines, a plurality of data lines and a plurality of common lines, an upper substrate 103 on which a common electrode (not shown) is formed for providing common voltages to the common lines, and liquid crystals (not shown) injected between the lower and upper substrates 101 and 103, respectively.

Also, the liquid crystal display device further includes a gate line driving circuit 110 for providing scanning signals to the plurality of gate lines of the liquid crystal panel 100, a data line driving circuit 120 for providing R, G, B data signals to the data lines, and a backlight system 130 for providing three primary colors of light, R, G, B, to the liquid crystal panel 100.

The backlight system 130 includes three R, G, B backlights 131, 133 and 135, respectively, three primary colors of light, R, G, B, respectively, and a light guide plate 137 for providing R, G, B light s emitted from the R, G, B backlight 131, 133 and 135, respectively , to liquid crystal of the liquid crystal panel 100.

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

A liquid crystal display device of a color field sequential driving mode according to an embodiment of the present invention has a structure as shown in FIG. 1. The liquid crystal display device of the present invention is intended to improve the flicker. To this end, a driving frequency is increased so as not to feel a difference in the amount of transmitted light between each frame, so that the flicker is not visually recognized.

Meanwhile, in order to improve the flicker, it should be required to increase the driving frequency. However, the increase of the driving frequency reduces driving capability. In other words, if the driving frequency increases, a scanning signal or a gate pulse decreases in width, the latter being applied to a gate line of a liquid crystal panel 100 from a gate line driving circuit 110 shown in FIG. 1. Therefore, if the gate pulse having a very narrow width is applied to the corresponding gate line, a switching transistor is not sufficiently turned on. Thereby, data signals from the data line driving circuit 130 are not sufficiently transmitted to a liquid crystal cell of the liquid crystal panel 100.

Furthermore, if the driving frequency increases, the display device undergoes deterioration of characteristics. That is, if the driving frequency increases, it is possible to improve the flicker but it is impossible to avoid the decrease of contrast. The contrast represents the difference in brightness between the white state and the black state, and a contrast ratio refers to the ratio of the brightness in the white state to the brightness in the black state.

Typically, in order to display images in the display device, the contrast ratio must be 100 or more. That is, assuming that the brightness in the black state is 1, the brightness in the white state must be 100 or more.

Therefore, one of the features of the present invention is focused on the driving frequency so as to improve the flicker and obtain good operational characteristics in the display device.

Figure 2:
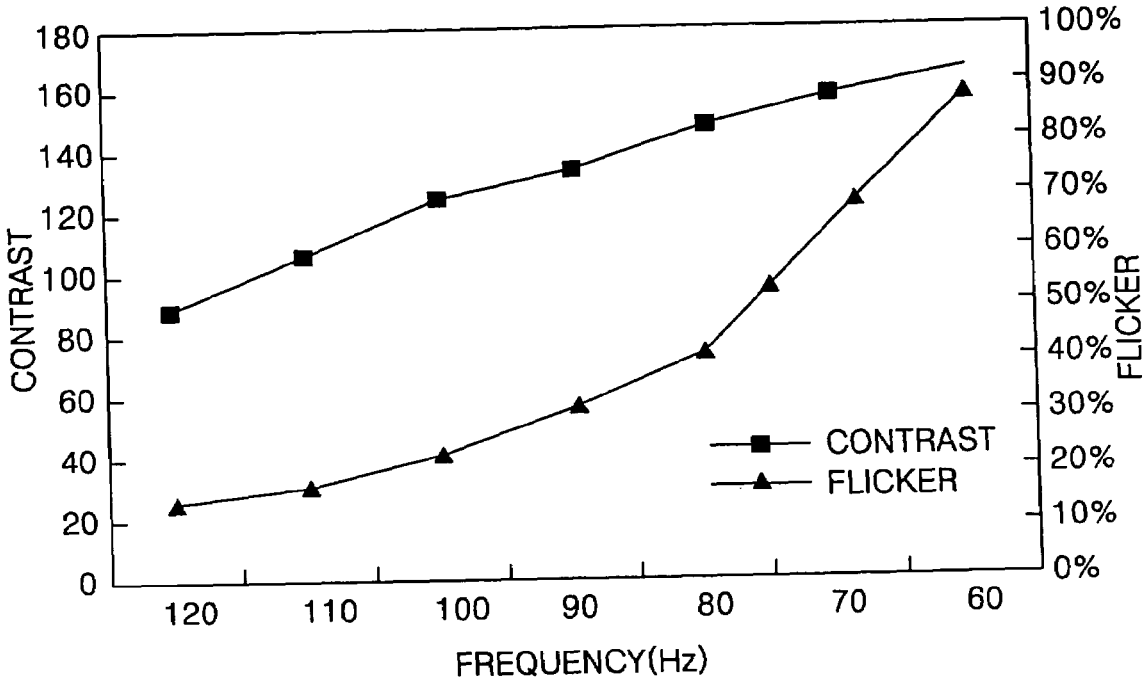
FIG. 2 shows a relationship between a contrast ratio and flicker based on the number of driving bits in a liquid crystal display device of a color field sequential driving mode according to an embodiment of the present invention.

FIG. 2 shows a relationship between a contrast ratio and flicker based on the number of driving bits in a liquid crystal display device of a color field sequential driving mode according to an embodiment of the present invention.

Referring to FIG. 2, it can be appreciated that, as the driving frequency increases, the flicker is reduced and the contrast is deteriorated.

Table 1 is to tabulates the flicker and the contrast ratio against each driving frequency shown in FIG. 2, where the flicker is measured using flicker measuring equipment from YOKOKAWA Company. When the flicker measured by the flicker measuring equipment has a value less than 45%, this value cannot be visually recognized.

TABLE 1

| | Driving frequency | | | | | | |
|---|---|---|---|---|---|---|---|
| | 120 | 110 | 100 | 90 | 80 | 70 | 60 |
| Contrast ratio | 87 | 105 | 123 | 134 | 148 | 157 | 167 |
| Flicker | 12% | 15% | 21% | 30% | 39% | 64% | 88% |
| Degree of flicker | X | X | low | low | low | middle | high |

In Table 1, the symbols "X" and "low" mean that the flicker is generated to such a degree that the flicker is not recognized or is little recognized visually, and "middle" means that the flicker is generated to such a degree that the flicker is visually recognized, and "high" means that the flicker is generated to such a degree that the flicker is clearly recognized visually.

It can be seen from FIG. 2 and Table 1 that, in the present invention, the liquid crystal cells of the liquid crystal panel are driven by setting a frequency satisfying two conditions that the flicker is less than 45% and that the contrast ratio is more than 100 as the driving frequency for driving one frame. Accordingly, the liquid crystal panel is driven in the field sequential mode with the driving frequency set by the frequency ranging from 80 to 110 Hz satisfying two conditions that the flicker is less than 45% and that the contrast ratio is more than 100.

As stated above, in the present invention, the driving frequency driving one frame is set to the range from 80 to 110 Hz, so that it is possible to improve the flicker generated on inverse driving without adjustment of the common voltage level and decrease in characteristics of the display device.

The present invention can be realized as computer-executable instructions in computer-readable media. The computer-readable media include all possible kinds of media in which computer-readable data are stored or included or can include any type of data that can be read by a computer or a processing unit. The computer-readable media include for example, but are not limited to storage media, such as magnetic storage media (e.g., ROMs, floppy disks, hard disk, and the like), optical reading media (e.g., CD-ROMs (compact disc-read-only memory), DVDs (didital versatile discs), re-writable versions of the optical discs, and the like), hybrid magnetic optical disks, organic disks, system memory (read-only memory, random access memory), non-volatile memory such as flash memory or any other volatile or non-volatile memory, and other semiconductor media. electronic media, electromagnetic media, infrared, and other communication media such as carrier These instructions and the data may be transmitted via such transmission mediums as , for example, carrier waves (e.g., transmission via the Internet or another computer). Communication media are generally able to conduct the transmission of computer-readable instructions, data structures, program modules or other data in a modulated signal such as the carrier waves or other electromagnetic transport mechanism including any information delivery media. The instructions and the data stored on computer-readable media may be transmitted and received via such communication media including wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

As set forth hereinabove, since the liquid crystal display device of the field sequential driving mode according to the embodiment of the present invention is driven at the certain driving frequency, it is possible not only to improve the flicker and but also to obtain the desired contrast.

Although a preferred embodiment of the present invention has been described for illustrative purposes, those skilled in the art will appreciate that various modifications are possible without departing from the scope and spirit of the invention as disclosed in the accompanying claims.

What is claimed is:

1. A method of driving a liquid crystal display device of a field sequential driving mode, comprising steps of:

dividing one frame into at least three sub-frames;

displaying first, second, and third color images for each sub-frame on the liquid crystal display device;

measuring flicker using flicker measuring equipment; and controlling a driving frequency the one frame to satisfy conditions that a contrast ratio is at least 100 and the flicker measured by the flicker measuring equipment is less than 45%.

2. The method according to claim 1, wherein the driving frequency is between 80 Hertz and 110 Hertz.

3. The method according to claim 1, wherein the first color image is red, the second color image is green, and the third color image is blue.

4. A computer-readable medium for the storage of computer-executable instructions, and the computer -executable instructions dividing one frame into at least three sub-frames, and displaying a first light color image, a second light color image, and a third light color image for each sub-frame;

the method including measuring flicker generated at the display device by using flicker measuring equipment; and the computer-executable instructions controlling a driving frequency for driving the one frame to satisfy conditions that a contrast ratio is at least 100 and the flicker measured by the flicker measuring equipment is less than 45%.

5. The method according to claim 4, wherein the driving frequency, satisfying the condition that the flicker is less than 45%, is more than 80 Hertz.

6. A process for the storage of computer-executable instructions for driving a liquid crystal display device of a field sequential driving mode, comprising the steps of:

providing a physical data source, the physical data source accepting the computer-executable instructions, and the computer-executable instructions dividing one frame into at least three subframes, and displaying a first light color image, a second light color image and a third light color image for each sub-frame;

obtaining a measurement flicker generated at the display device by using measuring equipment; and controlling a driving frequency for driving the one frame to satisfy conditions that a contrast ratio is at least 100 and the measurement of flicker obtained from the flicker measuring equipment is less than 45%.

7. The process of claim 6, wherein the driving frequency is between 80 hertz and 110 Hertz.

* * * * *